US007964780B2

(12) United States Patent
Hotta et al.

(10) Patent No.: US 7,964,780 B2
(45) Date of Patent: Jun. 21, 2011

(54) ELECTRONIC PERCUSSION INSTRUMENT

(75) Inventors: Harumichi Hotta, Hamamatsu (JP); Takahiro Hara, Hamamatsu (JP); Atsushi Fukada, Hamamatsu (JP); Shinya Sakurada, Hamamatsu (JP)

(73) Assignee: Yamaha Corporation (JP)

( * ) Notice: Subject to any disclaimer, the term of this patent is extended or adjusted under 35 U.S.C. 154(b) by 193 days.

(21) Appl. No.: 12/414,154

(22) Filed: Mar. 30, 2009

(65) Prior Publication Data

US 2009/0241761 A1 Oct. 1, 2009

(30) Foreign Application Priority Data

Mar. 31, 2008 (JP) ..... 2008-091623

(51) Int. Cl.
*G10F 1/08* (2006.01)

(52) U.S. Cl. ..... 84/104; 84/411 R; 84/422.1; 84/723

(58) Field of Classification Search ..... None
See application file for complete search history.

(56) References Cited

U.S. PATENT DOCUMENTS 6,399,869 B1 * 6/2002 Sagastegui ..... 84/738
7,129,405 B2 * 10/2006 Moffatt et al. ..... 84/600
7,618,322 B2 * 11/2009 Shimizu et al. ..... 463/36
2004/0074375 A1 * 4/2004 Moffatt et al. ..... 84/464 A
2005/0262991 A1 * 12/2005 Arimoto ..... 84/735
2006/0144212 A1 * 7/2006 Hofmeister et al. ..... 84/724
2008/0034946 A1 * 2/2008 Aimi ..... 84/604
2010/0180755 A1 * 7/2010 Copeland et al. ..... 84/622

FOREIGN PATENT DOCUMENTS

JP 2006-259193 A 9/2006
JP 2007-6633 A 1/2007

* cited by examiner

*Primary Examiner* — Marlon T Fletcher
(74) *Attorney, Agent, or Firm* — Rossi, Kimms & McDowell LLP

(57) ABSTRACT

Each of a plurality of pad devices that can be moved independent of each other includes: a sensor section for detecting a strike; and a transmitting section for transmitting operation information according to an output of the sensor section with wireless communication. A receiving section is provided in connection with a sound generating device to receive the operation information transmitted from each of the pad devices with wireless communication. The sound generating device generates a musical tone signal in accordance with the received operation information. A pad location detecting section detects a location of each of the pad devices. The sound generating device carries out tone generation control, for example, sound image localization control, for the musical tone signal generated in correspondence with each of the pad devices in accordance with the location of each of the pad devices detected by the pad location detecting section.

6 Claims, 4 Drawing Sheets

ELECTRONIC PERCUSSION INSTRUMENT

BACKGROUND

The present invention relates to an electronic percussion instrument such as an electronic drum. More specifically, the present invention relates to an electronic percussion instrument capable of facilitating arrangement of pad devices, a setup of a sound generating device and the like.

A conventional electronic drum (electronic percussion instrument) is constructed as a musical instrument of a drum set by arbitrarily combining a plurality of pad devices (referred to as a unit "pad"), as shown in Japanese Patent Application Laid-open Publication No. 2007-06633 or Japanese Patent Application Laid-open Publication No. 2006-259193, for example. When any of pad devices receives a strike operation from a user, a performance signal is transmitted from the pad device to a sound generating device via a cable in accordance with the strike operation. The sound generating device generates and sounds a musical tone of a percussion instrument on the basis of the performance signal in correspondence with a setup state of the pad device. Further, the number of pad devices can be increased in user's preference, and a location at which each of the pad devices is to be installed can be determined in user's preference. Further, the user sets up the sound generating device appropriately, by which it is possible to generate a desired musical tone therefrom.

In the conventional electronic drum, in the case where the number of pad devices is increased or an installed location of any pad device is changed by the user, or in the case where the drum set is moved or reestablished, various setups, such as handling of the cable to be connected to each of the pad devices and a setup of sound image localization in the sound generating device in accordance with the installed locations of the pad devices, become troublesome.

Further, in the case where a length of the cable to connect each of the pad devices to the sound generating device is adequate, handling of the excess cable is burdensome. In the case where the excess cable is bundled, its appearance is bad, noise may be generated, or dust tends to be collected. Moreover, since the number of cables is too many, it is easy to be subject to wrong connection, and its weight tends to be heavy. In this regard, in the case where the length of the cable is inadequate, the radius of installation of the pad devices is limited.

SUMMARY OF THE INVENTION

In view of the foregoing, it is an object of the present invention to get rid of troublesomeness of cables and badness of appearance, to increase the number of pad devices easily, and to install a plurality of pad devices easily in an electronic percussion instrument provided with the pad devices that can be moved and installed separately and each of which has a sensor section for detecting a strike against a pad surface thereof.

In order to achieve the above-mentioned object, an electronic percussion instrument according to the present invention is an electronic percussion instrument, including: a plurality of pad devices that can be moved independent of each other, each of the pad devices including: a sensor section for detecting a strike applied to the pad device; and a transmitting section for transmitting operation information according to an output of the sensor section with wireless communication; a receiving section capable of receiving the operation information transmitted from each of the pad devices with wireless communication; and a sound generating device for generating a musical tone signal in accordance with the operation information received by the receiving section.

According to the present invention, since there is no cable between each of the pad devices and the sound generating device, it is possible to get rid of troublesomeness of cables and badness of appearance as a conventional manner. In addition, it is possible to increase the number of pad devices easily, and to install the pad devices easily. Further, it is possible to get rid of complicated setups, such as assembling of a drum set, addition of a new pad device to the pad devices, or change in installed locations of the pad devices.

As one example, the electronic percussion instrument further includes a pad location detecting section for detecting a location of each of the pad devices, wherein the sound generating device carries out tone generation control for the musical tone signal generated in correspondence with each of the pad devices in accordance with a location of each of the pad devices detected by the pad location detecting section. The tone generation control for the musical tone signal includes sound image localization control, for example. Thus, locations at which the pad devices are arranged in an electronic drum set are detected, and the sound generating device carries out tone generation control for a musical tone signal in correspondence with each of the pad devices in accordance with the location of this pad device. Therefore, it is possible to carry out the tone generation control of panning and the like automatically without setups by a user, for example. This allows musical tones to be generated like an actual drum set.

BRIEF DESCRIPTION OF THE DRAWINGS

The foregoing and other objects, features and advantages of the present invention will become more readily apparent from the following detailed description of a preferred embodiment of the present invention that proceeds with reference to the appending drawings, in which.

DETAILED DESCRIPTION

Figure 1:
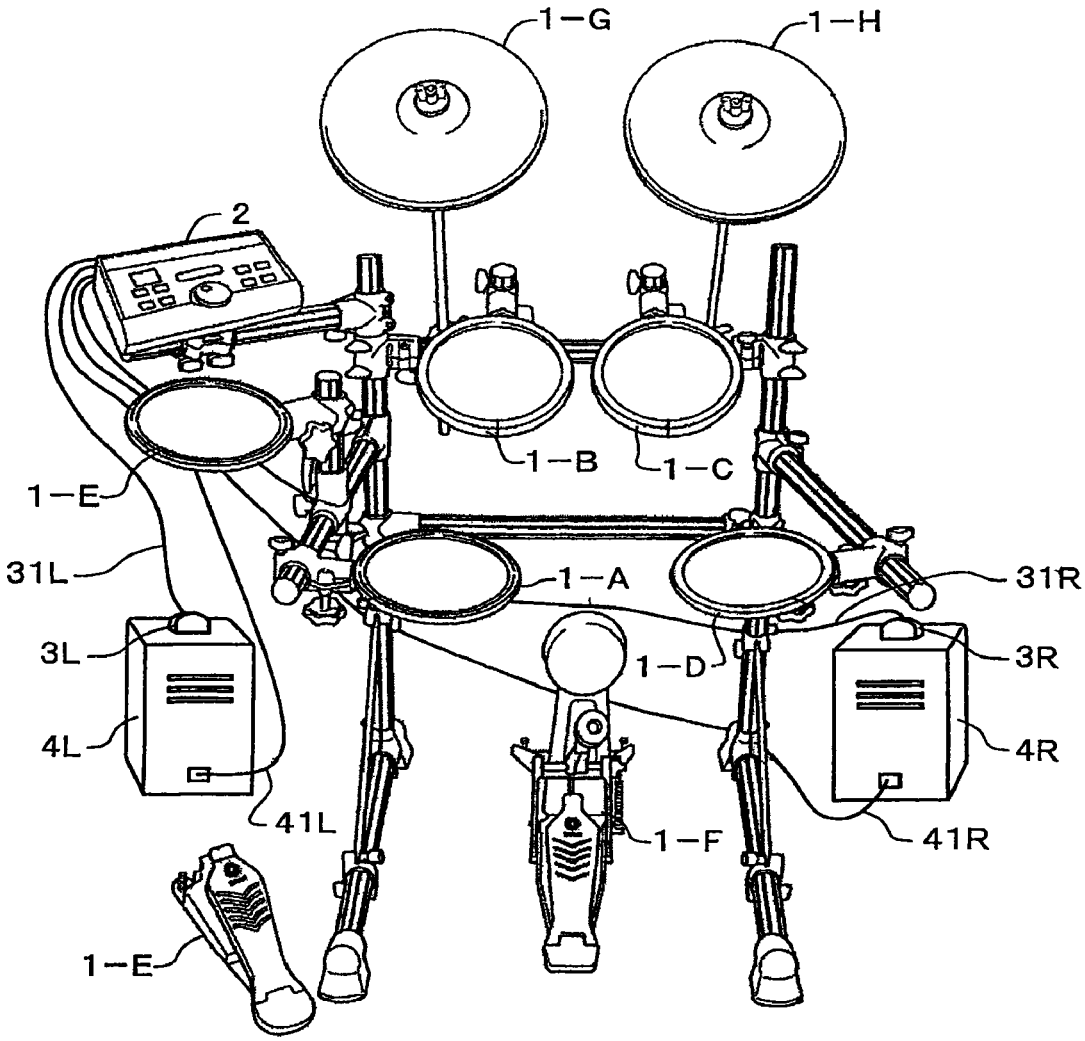
FIG. 1 is a view showing a drum set of an electronic drum and speakers according to an embodiment of the present invention.

One embodiment of the present invention will now be described with reference to the accompanying drawings. FIG. 1 is a view showing a drum set of an electronic drum and speakers according to an embodiment of the present invention. In FIG. 1, reference numerals 1-A to 1-H denote pad devices of a drum set. A reference numeral 1-A denotes a snare drum, a reference numeral 1-B denotes a first tom-tom drum, a reference numeral 1-C denotes a second tom-tom drum, a reference numeral 1-D denotes a third tom-tom drum, a reference numeral 1-E denotes a hi-hat and a pedal, a reference numeral 1-F denotes a bass drum, a reference numeral 1-G denotes a first cymbal, and a reference numeral 1-H denotes a second cymbal. Further, the drum set is provided with a sound generating device 2, right and left light emitting devices 3R, 3L, and right and left speakers 4R, 4L. The respective speakers 4R, 4L are connected to the sound generating device 2 via cables 41R, 41L, and the respective light emitting devices 3R, 3L are connected to the sound generating device 2 via cable 31R, 31L. In this regard, in the following explanation, the pad devices 1-A to 1-H will be described as the "pad device 1" appropriately.

Figure 2:
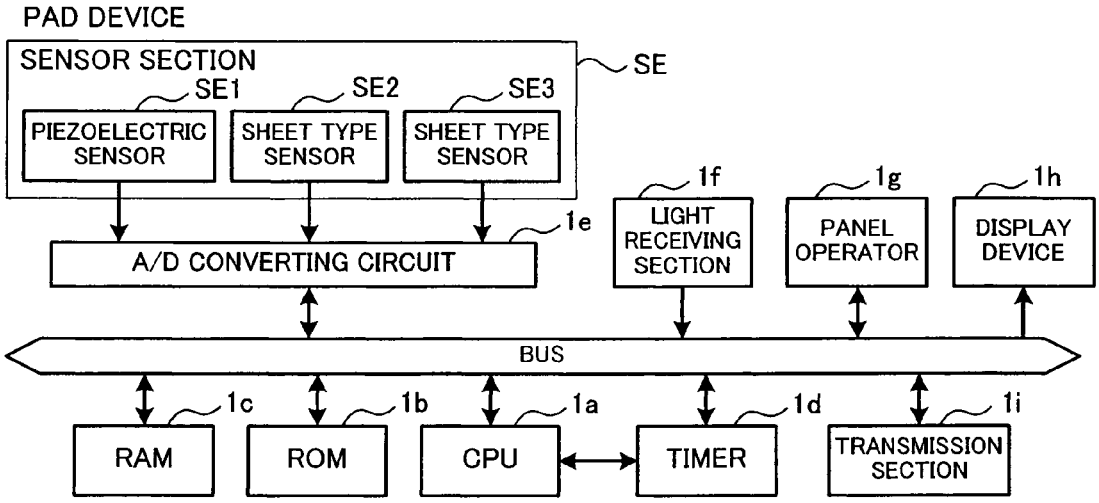
FIG. 2 is a block diagram of a pad device according to the embodiment.

FIG. 2 is a block diagram of each of the pad devices 1-A to 1-H. The pad device 1 in this embodiment includes a CPU 1*a*, a ROM 1*b*, a RAM 1*c* and a timer 1*d*, which constitute a control section. The pad device 1 further includes a sensor section SE, an A/D converting circuit 1*e* for subjecting a performance operation signal (sensor signal) from the sensor section SE to A/D conversion, a light receiving section 1*f*, a panel operator 1*g*, a display device 1*h* and a transmitting section 1*i*. All of the sections are connected to each other via a bus. The CPU 1*a* executes control of the entire pad device 1 using a working area of the RAM 1*c* on the basis of control programs stored in the ROM 1*b*. In this regard, the timer 1*d* is a circuit for generating a clock signal and the like used to detect timing of light receiving (will be described later).

The sensor section SE shown in FIG. 2 is an example of the pad device 1-A, i.e., the snare drum. The sensor section SE includes: a piezoelectric sensor SE1 for detecting intensity of a strike; a first sheet type sensor SE2 for detecting a strike position on a pad surface of the pad device 1; and a second sheet type sensor SE3 for detecting a strike position of a rim portion around the pad surface. Performance operation signals (strike detected information) from the respective sensors, such as a strike intensity detected signal and a strike position detected signal (hereinafter, both signals are also referred to as "operation information"), are outputted to the A/D converting circuit 1*e*, and then converted into digital signals in the A/D converting circuit 1*e*. The performance operation signals outputted from the A/D converting circuit 1*e* are taken (or retrieved) in the CPU 1*a*.

The light receiving section 1*f* includes a light receiving element for receiving infrared rays, for example. The light receiving section 1*f* receives infrared rays from the light emitting devices 3R, 3L to output the light receiving signal to the bus as a digital signal. This light receiving signal is then taken in the CPU 1*a*. The CPU 1*a* detects (or recognizes) a location of the pad device 1 (that is, a relative location between the pad device 1 and each of the speakers 4R, 4L), will be described later. In this case, the control section including the CPU 1*a* functions as a pad location detecting section. The panel operator 1*g* includes various switches and the like. An operation signal of this panel operator 1*g* is taken in the CPU 1*a*, and the CPU 1*a* executes a process according to each of operation events. Various kinds of setup information for the pad device 1 are displayed on the display device 1*h*.

The transmitting section 1*i* is a circuit for transmitting data with a short-range wireless communication standard such as ZigBee, for example. Data on performance operation signals are transmitted from this transmitting section 1*i*. The performance operation signals to be transmitted from the transmitting section 1*i* include data on an IP address (identification signal) of the pad device and data on the type of pad (hereinafter, both data are referred to as "pad identification information") in addition to the strike intensity detected signal and the strike position detected signals described above. These transmission data are then received by the sound generating device 2. In this regard, this transmitting section 1*i* is equipped with a power supply such as a battery. Operations of the respective sections including the CPU 1*a* of the pad device 1 are also carried out with this power supply. Further, in a communication standard of ZigBee, a transfer distance is short, but ZigBee is suitable for a narrow range communication such as communication in this drum set. ZigBee has a feature that it is inexpensive and electric power consumption is low. In this regard, electric power may be applied to each of the pad devices 1 from an electrode provided on a frame, to which the corresponding pad device 1 is attached (see FIG. 1).

Figure 3:
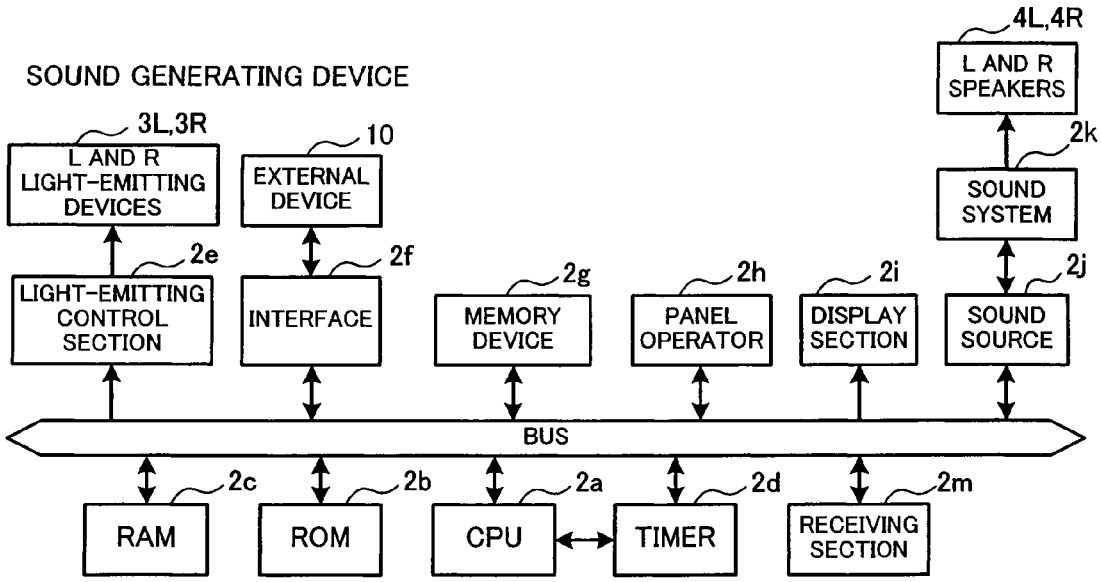
FIG. 3 is a block diagram of a sound generating device according to the embodiment.

FIG. 3 is a block diagram of the sound generating device 2. The sound generating device 2 in this embodiment includes a CPU 2*a*, a ROM 2*b*, a RAM 2*c* and a timer 2*d*, which constitute a control section. The sound generating device 2 further includes a light emitting control section 2*e*, an interface 2*f*, a storage device 2*g*, a panel operator 2*h*, a display device 2*i*, a sound source 2*j*, a sound system 2*k* and a receiving section 2*m*. All of the sections are connected to each other via a bus. The CPU 2*a* executes control of the entire sound generating device 2 using a working area of the RAM 2*c* on the basis of control programs stored in the ROM 2*b* and the storage device 2*e*. In this regard, the timer 2*d* is a circuit for generating a clock signal and the like to execute control of timing of light receiving by the light emitting control section 2*e* and the like.

The light emitting control section 2*e* is a circuit for carrying out light emitting control of the light emitting devices 3R, 3L. The light emitting control section 2*e* controls each of the light emitting devices 3R, 3L so as to emit infrared rays to different emission angles in a range of the drum set, that is, a range in which the pad devices 1-A to 1-H are arranged while delaying the timing of light emitting.

The interface 2*f* is used to transfer data between the sound generating device 2 and an external device 10. The interface 2*f* reads out automatic performance data from the external device 10, and outputs performance data generated by the sound generating device 2 in accordance with performance of the drum set to the external device 10. In this case, the external device 10 is a performance equipment such as a MIDI device, a personal computer or the like. Control software for the sound generating device 2, automatic performance data and the like are stored in the storage device 2*g*.

The panel operator 2*h* includes various switches and the like. An operation signal of this panel operator 2*h* is taken in the CPU 2*a* and the CPU 2*a* executes a process according to each of operation events. Further, various kinds of setup information for the sound generating device 2 are displayed on the display device 2*i*. The sound source 2*j* generates a musical tone signal in accordance with performance data generated by the CPU 2*a* (control section), and outputs the musical tone signal to the sound system 2*k*. The sound system 2*k* subjects the musical tone signal to D/A conversion, and outputs it to the right and left speakers 4R, 4L.

The receiving section 2*m* is a circuit for receiving data with a short-range wireless communication standard, for example, ZigBee. The receiving section 2*m* receives transmission data transmitted from the transmitting section 1*i* of each of the pad devices 1 with wireless communication independently. The reception data thus received are taken in the CPU 2*a*. The CPU 2*a* identifies from which pad device 1 the reception data are transmitted on the basis of the IP address in the reception data, and executes a process in correspondence with each of the pad devices 1.

In one embodiment, the sound generating device 2 determines a tone color of a percussion instrument sound to be generated on the basis of data on a pad type included in the pad identification information of the received performance operation signal (performance information), and generates the tone color of the percussion instrument thus determined. In such a case, as is known in the art, the musical tone generation is controlled so that a different tone color is achieved in accordance with whether a strike position detected signal is outputted from the first sheet type sensor SE2 for the pad surface or the second sheet type sensor SE3 for the rim portion. Moreover, the tone color may be controlled depending on a detailed strike position.

As another example, tone color setup information may be included in the performance operation signal (performance information) transmitted from each of the pad devices 1-A to 1-H. In such a case, the sound generating device 2 generates a percussion instrument sound of a tone color on the basis of the tone color setup information in the received performance operation signal (performance information).

Figure 4:
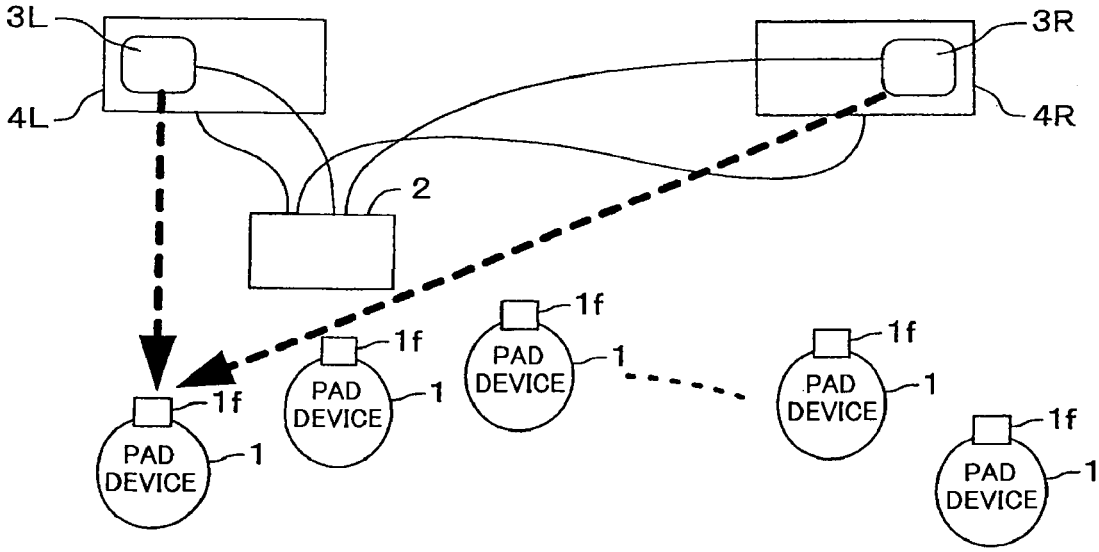
FIG. 4 is a view for explaining a pad location detecting section according to the embodiment.
Figure 5:
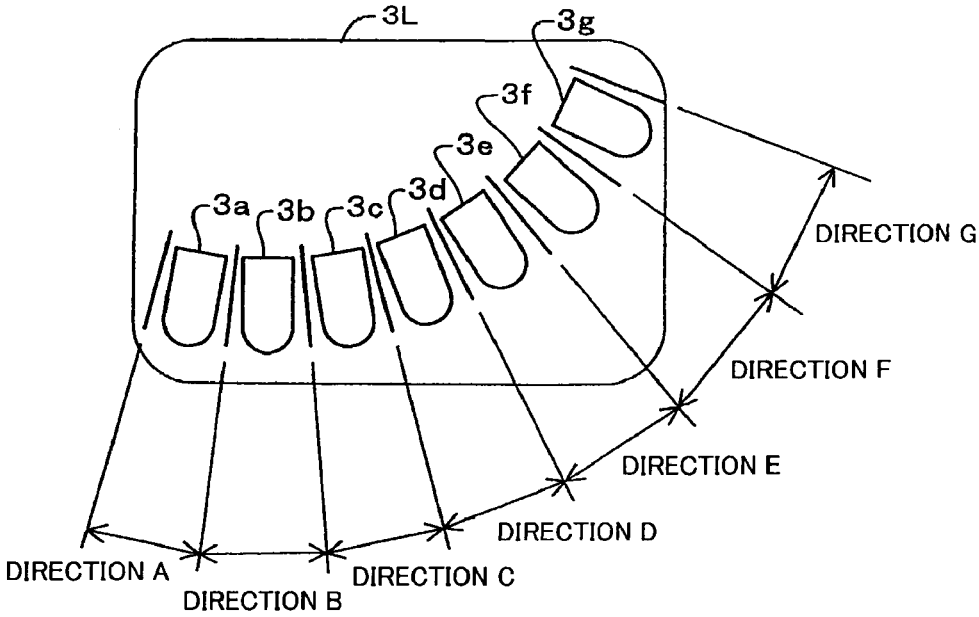
FIG. 5 is a view for explaining a light emitting device according to the embodiment.

FIG. 4 is a view for explaining a pad location detecting section according to the present embodiment, and FIG. 5 is a view for explaining the light emitting devices 3R, 3L. As shown in FIG. 4, infrared rays are emitted from each of the right light emitting device 3R mounted on the right speaker 4R and the left light emitting device 3L mounted on the left speaker 4L, as shown with respective arrows of heavy broken lines. The infrared rays are emitted in a pulse manner so that each of the light emitting devices 3R, 3L is moved by a predetermined angle range with different timing of light emitting.

For example, FIG. 5 shows a configuration of the left light emitting device 3L. This left light emitting device 3L is provided with a plurality (seven in this example) of light emitting elements (for example, infrared-emitting LEDs) 3*a* to 3*g*. The light emitting elements 3*a* to 3*g* are arranged so that angles thereof are shifted bit by bit. This allows the respective light emitting elements 3*a* to 3*g* to emit pulses of infrared rays to different angle directions (direction a to direction g). The infrared rays are in turn emitted in order of the light emitting elements 3*a* to 3*g* with shift of the timing. The right light emitting device 3R is provided with light emitting elements 3*a* to 3*g* so as to become reflection symmetry with respect to this left light emitting device 3L. This right light emitting device 3R also emits pulses of infrared rays to different angle directions (direction a to direction g).

Each of the pad devices 1 receives the emitted infrared rays by means of the light receiving section 1*f*. In this regard, all of the pad devices 1 are arranged within the entire angle range from the direction a to the direction g. Conversely, the directions a to g are also set thereto. Therefore, each of the pad devices 1 is allowed to receive infrared rays emitted to any direction of the directions a to g.

Detection of locations of the pad devices 1 is carried out as follows. Each of the light emitting devices 3R, 3L causes all of the light emitting elements 3*a* to 3*g* to emit infrared rays at the same time. Thus, the entire pad devices 1 receive the infrared rays emitted at the same time by means of the light receiving sections 1*f*, and monitor timing of light receiving of next pulse using this timing of light receiving as a reference. Namely, the light emitting devices 3R, 3L in turn emit infrared rays after the light emission at the same time by means of the light emitting elements 3*a* to 3*g* while shifting timing. Each of the pad devices 1 that receives these infrared rays can recognize from which direction the subsequent infrared rays are emitted with respect to each of the light emitting devices 3R, 3L on the basis of the timing of receiving the infrared rays after the timing of the above reference.

Thus, each of the pad devices 1 can detect (or recognize) a location of its own device with respect to the light emitting devices 3R, 3L (a distance and a direction relative to each of the light emitting devices 3R, 3L) on the basis of the direction of the infrared rays emitted from each of the two light emitting devices 3R, 3L. For example, FIG. 4 shows the case where the pad device 1 specified by arrows receives the infrared rays in the direction b emitted by the light emitting element 3*b* of the left light emitting device 3L, and receives the infrared rays in the direction g emitted by the light emitting element 3*g* of the right light emitting device 3R. As described above, each of the pad devices 1 detects a location at which its own device is placed, and transmits locational information on this detected location to the sound generating device 2 together with information on an IP address of its own device. The sound generating device 2 grasps a locational relationship (relative location) between the respective pad devices 1 and the speakers 4R, 4L on the basis of this locational information, and carries out control of panning for musical tones of each of the pad devices 1.

In this regard, as a modified example, the electronic percussion instrument may be configured so that the sound generating device 2 detects a location of each of the pad devices 1 using a photo scanner or a sonar scanner, for example. Moreover, as another example, a user may input locational information on the pad devices 1 using a data input device.

In this regard, although the emission direction has been detected at timing of receiving the subsequent infrared rays in the example described above, the light emitting elements 3*a* to 3*g* of each of the light emitting devices 3R, 3L may emit infrared rays with different wavelengths, and each of the pad devices 1 may detect the direction on the basis of the wavelength of the received infrared rays.

Figure 6:
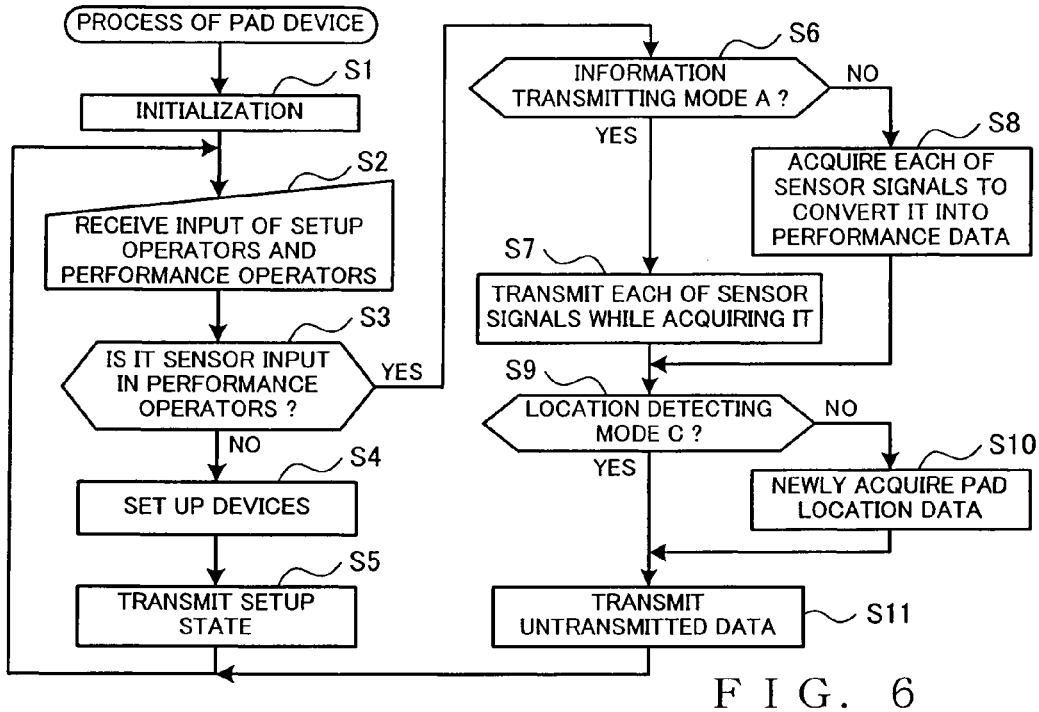
FIG. 6 is a flowchart of a control program for the pad device according to the embodiment.
Figure 7:
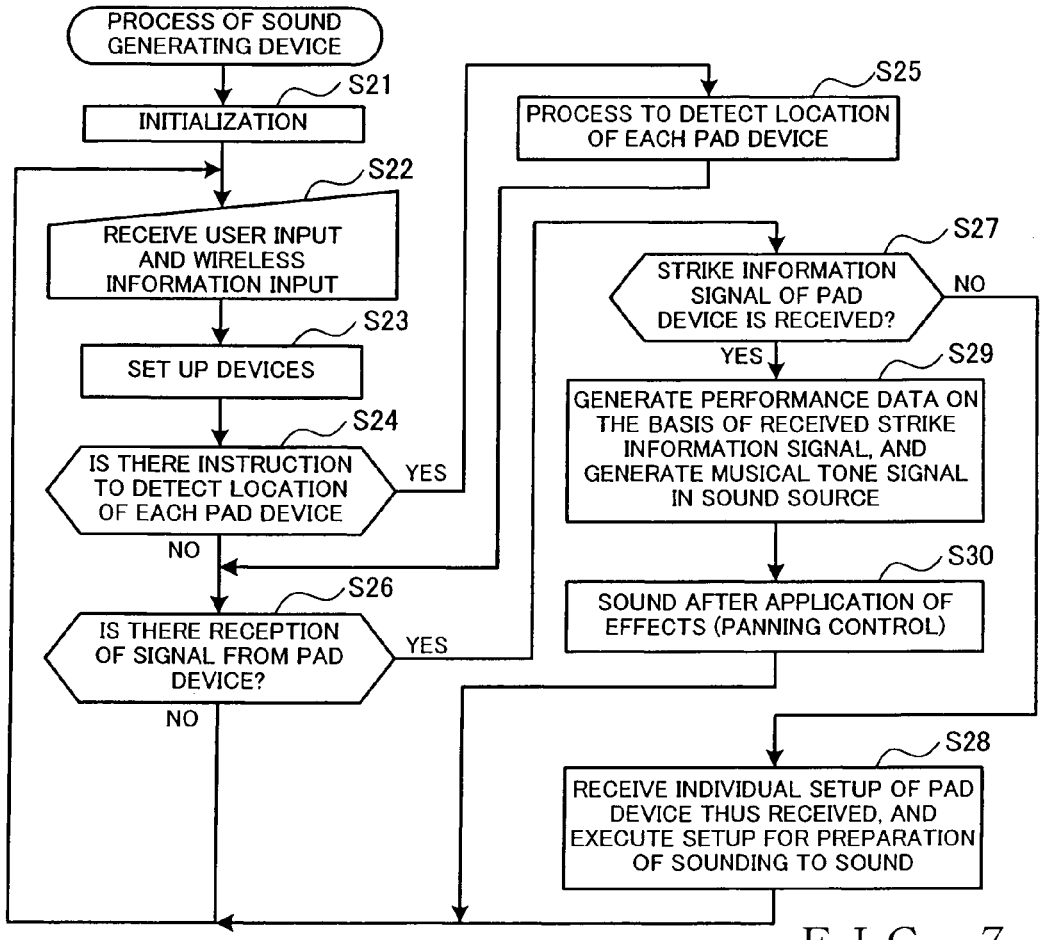
FIG. 7 is a flowchart of a control program for the sound generating device according to the embodiment.

Next, one example of operation of the present embodiment will be described on the basis of flowcharts. FIG. 6 is a flowchart of a control program for the pad device 1, and FIG. 7 is a flowchart of a control program for the sound generating device 2.

A process in FIG. 6 is started by activation of a power supply for the pad device 1, and continues to operate until the power supply is tuned off. An initialization process such as a flag and reset of registers is first executed at Step S1. At Step S2, reception of an input of various setup operators and reception of an input of performance operators (pad devices 1 and the like) are executed, and the processing flow waits until there is any input. In the case where there is any input, it is determined at Step S3 whether the input is an input of a signal from any sensor of the performance operators or not. In the case where the input is the input of the signal from any sensor, processes after Step S6 are executed. In the case where the input is not the input of the signal from any sensor, the input is an input of a setup operator. Thus, a setup of various devices is executed at Step S4, and information on a setup state is transmitted from the transmitting section 1*i* at Step S5.

In the setup of the devices described above, for example, the user is allowed to manually carry out processes such as a setup of sensitivity of the sensors in the pad device 1, allocation of functions to outputs of the sensors, a setup of a tone color and a setup of locations of the pad devices 1. Further, in this embodiment, it is possible to select any of an information transmitting mode A and an information transmitting mode B with respect to transmission of a performance operation signal. In addition, it is possible to select any of a location detecting mode C and a location detecting mode D with respect to location detection of the pad devices 1. Setups of these modes are also carried out in the setup of the devices described above.

On the other hand, in the case where it is determined at Step S3 that the input is an input of a signal from any sensor, the processing flow proceeds to Step S6. Then, in the case where the information transmitting mode A described above is set up, the processing flow proceeds to Step S7. In the case where the information transmitting mode B is set up, the processing flow proceeds to Step S8. In the case of the information transmitting mode A (Step S7), a sensor signal is acquired from the sensor section SE of the pad device 1 and transmitted as a performance operation signal as it is. In this information transmitting mode A, the pad device 1 converts information on the sensor signal detected by the sensor section SE as the performance operation signal into performance information, and transmits it with wireless communication. The sound generating device 2 starts to sound on the basis of the minimum information thus received, and changes tone generation while constructing the received information in turn. For example, the electronic percussion instrument executes the process so that sounding is first started with a normal tone color on the basis of identification information of the pad device 1 and an output from the sensor section SE (for example, an output from the piezoelectric sensor SE1); the tone color is changed on the basis of identification information and information on the detected strike position that are next received; and panning (control of sound image localization) is changed on the basis of identification information and installed location information that are further next received. In the case of the information transmitting mode B (Step S8), a sensor signal is acquired from the sensor section SE of the pad device 1. In the case where one set of sensor signals are gathered, this is converted into performance data, and the performance data are then transmitted as a performance operation signal.

Next, the processing flow proceeds to Step S9. In the case where the location detecting mode C is set up, the processing flow directly proceeds to Step S11. In the case where the location detecting mode D is set up, the processing flow proceeds to Step S10. The location detecting mode C is a mode in which by detecting a location of each of the pad devices 1 in advance, the detected locations have already been transmitted, or a mode in which the user inputs a location of each of the pad devices 1 as pad location data and the inputted pad location data have already been transmitted.

The location detecting mode D is a mode to newly detect a location of each of the pad devices 1. At Step S10, by receiving the infrared rays as described above, a location of each of the pad devices 1 is detected, and the processing flow then proceeds to Step S11. In this regard, in the case of this location detecting mode D, the sound generating device 2 carries out a light emitting process and the like by means of the light emitting devices 3R, 3L.

At Step S11, untransmitted data are transmitted. Namely, in the case of the information transmitting mode B, the performance data are transmitted to the sound generating device 2. In the case of the location detecting mode D, the pad location data newly detected are transmitted to the sound generating device 2. In this regard, in the case of the information transmitting mode A or the location detecting mode C, no data are to be transmitted at Step S11.

A process in FIG. 7 is started by activation of a power supply for the sound generating device 2, and continues to operate until the power supply is turned off. An initialization process such as a flag and reset of registers is first executed at Step S21. At Step S22, reception of an input of various setup operators is executed. In the case where there is any input, the devices are set up in accordance with the input state at Step S23. In the case where there is no input, the processing flow directly proceeds to Step S24. In this regard, a setup of the information transmitting mode and a setup of the location detecting mode are executed in this setup process.

At Step S24, it is determined whether there is an instruction to detect a location of each of the pad devices 1 or not, that is, whether it is set to the location detecting mode D or not. In the case where it is set to the location detecting mode D, a process to detect a location of each of the pad devices 1 including control of the light emitting devices 3R, 3L is executed at Step S25, and the processing flow then proceeds to Step S26. At Step S26, it is determined whether there is reception of a signal from any pad device 1 or not. In the case where there is any reception, the processing flow proceeds to Step S27. In the case where there is no reception, the processing flow returns to Step S22.

At Step S27, it is determined whether the received signal is a strike information signal (that is, a strike intensity detected signal and a strike position detected signal) of the pad device 1 (sensor signal in the information transmitting mode A) or not. In the case where the received signal is not a strike information signal, the received signal denotes performance data. Thus, at Step S28, an individual setup of the pad device 1 from which the signal is received is received, and a setup for preparation of sounding is executed on the basis of the performance data to execute a sounding process. The processing flow then returns to Step S22.

In the case where the received signal is a strike information signal, at Step S29, performance data are generated on the basis of the received strike information signal. At the time when performance data of the minimum necessary are constructed, a musical tone signal is generated in the sound source 2*j*. Then, at Step S30, effects such as control of panning are applied thereto, and sounding is executed. The processing flow then returns to Step S22.

The processes described above allow a musical tone according to performance in each of the pad devices 1 to be generated from the sound generating device 2 without connecting each of the pad devices 1 to the sound generating device 2 via cables. Further, in the case of the location detecting mode D, when any pad device 1 is moved, a new location of the pad device 1 is automatically detected, and control of panning (sound image localization control) is executed in the sound generating device 2 in accordance with the new location of the pad device 1. Moreover, even in the case of the location detecting mode D, that is, even in the case where the user manually sets up (inputs) a new location of the pad device 1, it is possible to set up the electronic percussion instrument (electronic drum) just by carrying out input operations and the like for the sound generating device 2 and the pad devices 1.

Although the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention is accordingly to be defined as set forth in the appended claims.

The present application is based on, and claims priority to, Japanese Patent Application No. 2008-091623 filed on Mar. 31, 2008. The disclosure of the priority application, in its entirety, including the drawings, claims, and the specification thereof, is incorporated herein by reference.

What is claimed is:

1. An electronic percussion instrument comprising:

a plurality of pad devices that can be moved independent of each other, each of the pad devices comprising:

a sensor section for detecting a strike applied to the pad device; and a transmitting section for transmitting operation information according to an output of the sensor section with wireless communication;

a receiving section capable of receiving the operation information transmitted from each of the pad devices with wireless communication;

a sound generating device for generating a musical tone signal in accordance with the operation information received by the receiving section; and a pad location detecting section for detecting a location of each of the pad devices, wherein the sound generating device carries out tone generation control for the musical tone signal generated in correspondence with each of the pad devices in accordance with a location of each of the pad devices detected by the pad location detecting section.

2. The electronic percussion instrument as claimed in claim 1, wherein the sound generating device carries out sound image localization control for the musical tone signal generated in correspondence with each of the pad devices in accordance with the location of each of the pad devices.

3. The electronic percussion instrument as claimed in claim 1, wherein the pad location detecting section is provided in each of the pad devices, and the transmitting section in each of the pad devices transmits data on a location of the pad device detected by the pad location detecting section.

4. The electronic percussion instrument as claimed in claim 1, wherein the pad location detecting section is provided at the sound generating device.

5. The electronic percussion instrument as claimed in claim 1, further comprising:

a speaker for acoustically sounding on the basis of the musical tone signal generated by the sound generating device, wherein the pad location detecting section includes a transmitting section arranged in the speaker and a receiving section provided in each of the pad devices, wherein the transmitting section in the speaker transmits a signal for detection and the receiving section in each of the pad devices receives the signal for detection transmitted by the transmitting section in the speaker, and wherein the pad location detecting section detects a relative location between each of the pad devices and the speaker on the basis of the received signal for detection.

6. An electronic percussion instrument comprising:

a plurality of pad devices that can be moved independent of each other, each of the pad devices comprising:

a sensor section for detecting a strike applied to the pad device; and a transmitting section for transmitting operation information according to an output of the sensor section with wireless communication;

a receiving section capable of receiving the operation information transmitted from each of the pad devices with wireless communication;

a sound generating device for generating a musical tone signal in accordance with the operation information received by the receiving section; and a data input device for inputting data indicating a location of each of the pad devices, wherein the sound generating device carries out tone generation control for the musical tone signal, generated in accordance with each of the pad devices, in accordance with the location of each of the pad devices inputted via the data input device.

* * * * *